United States Patent [19]

Sweet

[11] Patent Number: 4,625,966

[45] Date of Patent: Dec. 2, 1986

[54] PLAYING CARD HOLDER WITH CURVATURE

[76] Inventor: Richard F. Sweet, 1454 Briarglen Ave., Westlake Village, Calif. 91361

[21] Appl. No.: 828,630

[22] Filed: Feb. 10, 1986

Related U.S. Application Data

[63] Continuation-in-part of Ser. No. 795,933, Nov. 7, 1985.

[51] Int. Cl.[4] ..... A63F 1/10

[52] U.S. Cl. ..... 273/150; 40/124.4

[58] Field of Search ..... 273/148 A, 150; 40/124.2, 124.4

[56] References Cited

U.S. PATENT DOCUMENTS

| | | | |
|---|---|---|---|
| 711,103 | 10/1902 | Freeman | 273/150 |
| 1,286,780 | 12/1918 | Ribeyre | 273/150 |
| 1,416,447 | 5/1922 | Castles | 273/150 |
| 2,474,763 | 6/1949 | Thomas | 273/148 A X |
| 2,520,490 | 8/1950 | Boward | 273/150 |
| 2,564,315 | 8/1951 | Stark et al. | 273/150 |
| 2,634,132 | 4/1953 | Freedman | 273/150 X |
| 2,665,916 | 1/1954 | Lakatos | 273/150 |
| 2,729,452 | 1/1956 | Baumann | 273/150 |
| 3,620,535 | 11/1971 | Carney et al. | 273/150 |

FOREIGN PATENT DOCUMENTS

| | | | |
|---|---|---|---|
| 474455 | 9/1952 | Italy | 273/150 |

*Primary Examiner*—Anton O. Oechsle

*Attorney, Agent, or Firm*—Koppel & Harris

[57] ABSTRACT

A playing card holder is described in which two plates with diverging inner surfaces extend upward from a base section. The two plates diverge from each other within an angular range of about 1°–8°, and preferably about 3°–5°, to form a tapered slot within which the playing cards are inserted. The inner surface of each plate is lined with a layer of a flocked material, the layers being partially set into recesses in the opposed surfaces of each plate. The holder retains either a single card or a number of overlapping cards securely in place once they have been inserted into the slot, and yet permits cards to be easily removed without dislodging adjacent cards. The remote ends of the holder are provided with a compound curvature in a direction generally perpendicular to the plane of the card holder which has been found to secure the cards from casual visual observation by other players, and yet preserves the ability of a flat card holder to easily and securely manipulate the cards.

16 Claims, 7 Drawing Figures

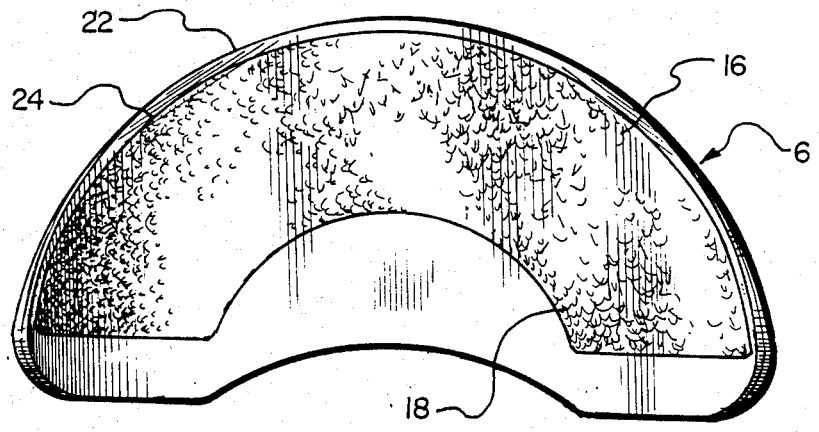
Fig. 5.
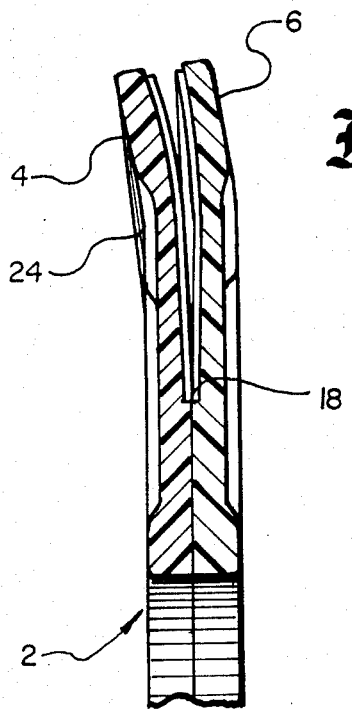
Fig. 3.
Fig. 7.
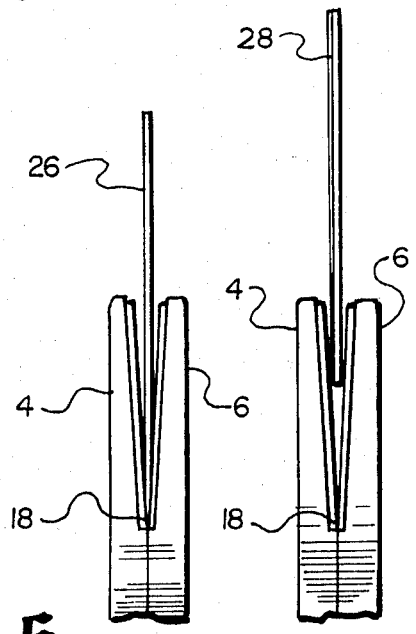
Fig. 6.

PLAYING CARD HOLDER WITH CURVATURE

BACKGROUND OF THE INVENTION

1. Field of the Invention

This is a continuation-in-part of Ser. No. 795,933, filed Nov. 7, 1985 by the present inventor and entitled "Playing Card Holder". This invention relates to playing card holders, and more particularly to holders adapted to stand by themselves and to hold a number of overlapping playing cards at the same time.

2. Description of the Prior Art

Several attempts have been made to construct a playing card holder that can be used by either adults or children during a card game. An ideal playing card holder should be capable of easily accepting either single cards or a number of overlapping cards and of allowing one card to be pulled out or dislodged without disturbing other cards, should display the cards so that they can be easily recognized and sorted by the user, and should be strong and durable in use. Unfortunately, no card holders are available which are known to satisfy all of these criteria. In addition, it would be desirable that the card holder simulate the action of a human hand as much as possible in holding cards. This would include features such as being able to hold the device comfortably in one's hand, being able to lay the cards face down without their falling out of the holder, and being able to set the holder upright either vertically or tilted back at an angle, all with a single unitary movement.

Visual security is also an important element in card games. The players want to know that other players cannot see the cards they are holding. Previously disclosed card holders did not have any specific mechanism for securing the cards from casual glances by other players.

SUMMARY OF THE INVENTION

The object of the present invention is to provide a novel and improved playing card holder which satisfies all of the requirements stated above, and which is also simple in construction and easy to use.

The card holder of the present invention includes first and second generally semicircular plates which are formed in a three-dimensional space oriented according to x, y and z axes. The peripheries of the two plates are defined by respective base diameter portions in the x-direction, and by arcuate portions which are generally disposed in the x,y plane and are generally symmetrical about a centerline in the y-direction. The plates are joined together inward of their arcuate peripheries, and have mutually opposed surfaces which diverge from each other away from the area of joinder to form a cardreceiving slot that releasably secures playing cards. The angular divergence between the plates is within the range of about 1°–8°, and preferably within about 3°–5°. The opposite plate sections which are remote from the centerline are curved generally arcuately in the z-direction about an axis which lies generally in the y-direction, thereby increasing the visual security of cards placed in the holder. Means are also provided to support the card holder in a generally upright position.

In the preferred embodiment the opposed surfaces of the plates are each coated with a layer of flocked material. The plate surfaces include recesses of slightly lesser depth than the thicknesses of the flocked layers, allowing the flocked material to be disposed within the recesses but still contact the playing cards. A stop surface forms the bottom of the slot along a generally arcuate path which is generally concentric with the arcuate periphery of the card holder, the slot being wide enough at the stop to receive a playing card. The holder is supported in a generally upright position on a horizontal surface at a substantially non-zero angle to vertical by means of a plurality of spaced foot members which extend outward from the bottom of one of the plates, or alternately can be stood up substantially vertically on its squared bottom.

The plate sections remote from the centerline are provided with a compound z-direction curvature which has been discovered to yield the unique combination of firmly holding cards in place, and yet easily accepting new cards or permitting cards to be removed. To this end, the upper portions of the plate section remote from the centerline are additionally defined by a generally arcuate curvature in the z-direction about an axis which lies generally in the x,y plane at substantial angles to both the x and y axes. The first z-direction curvature of the remote plate sections is preferably about a y-direction axis along an arc which extends in the approximate range of 25°–50° and preferably within about 35°–40° in the z-direction, with the curvature portion as a whole extending along approximately 15%–30% of the length of the base diameter and preferably 20%–25%. The additional z-direction curvature applied to the upper portions of the remote sections preferably extends along an arc in the approximate range of 20°–45° and preferably 30°–35° in the z-direction, with the additionally curved portion extending for approximately 10%–25% of the length of the base diameter and being inwardly spaced from the lateral end of the holder. The axis of curvature for the additional z-direction curvature preferably lies at an angle within the approximate range of 4°–8° to the x-axis.

Further features and advantages of the invention will be apparent to those skilled in the art from the following detailed description of preferred embodiments, taken together with the accompanying drawings, in which:

DESCRIPTION OF THE DRAWINGS

FIGS. 2 and 3 are sectional views taken along the lines 2—2 and 3—3 of FIG. 1, respectively;

FIG. 5 is an elevational view of the inner face of one of the plates which form the holder base; and FIGS. 6 and 7 are enlarged fragmentary sectional views of the playing card holder respectively showing relatively small and large numbers of playing cards held in the device.

DETAILED DESCRIPTION OF PREFERRED EMBODIMENTS

Figure 1:
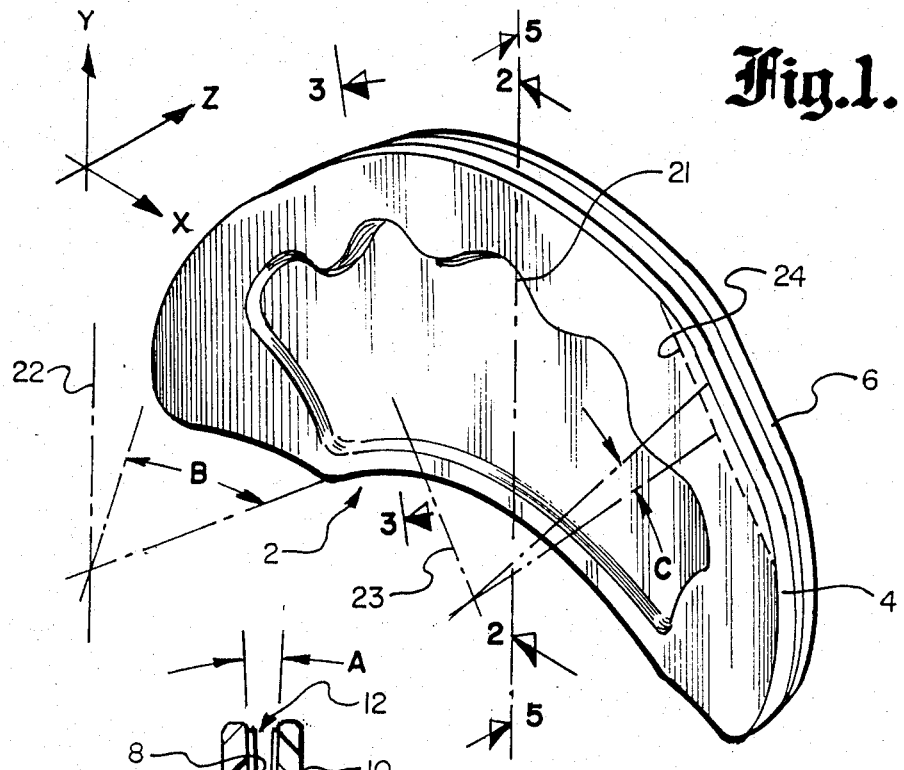
FIG. 1 is a perspective view of the playing card holder of the present invention.

A perspective view of a playing card holder constructed in accordance with the present invention is provided in FIG. 1. The holder includes a lower base section 2 from which a pair of plates 4 and 6 extend generally upward, the base section being formed integrally with the plates. The stand is preferably made from a stiffly flexible plastic material such as PVC, polyethylene, nylon, polypropylene, styrene, etc. It is preferably formed with an arcuate upper surface so that playing cards may be evenly distributed around the upper portion of the stand.

Figure 2:
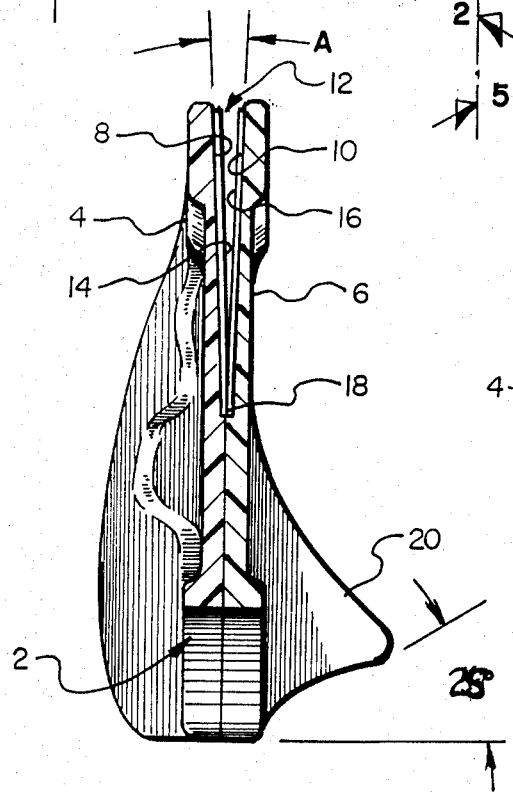

As best shown in FIGS. 2 and 3, the two plates 4 and 6 have mutually opposed inner surfaces 8 and 10 which diverge away from each other with increasing distance from the upper edge of base section 2. The two plates thus form a tapered slot 12 within which playing cards may be secured. The angle of divergence A between the two plates is within the approximate range of 1°–8°, and preferably is about 3°–5°. It is not essential that the plates maintain a constant angle of divergence throughout their lengths, but this is preferred. The plates 4 and 6 include arcuate recesses in their inner surfaces within which respective layers 14, 16 of a flocked material are partially disposed. The thicknesses of the flocked material layers are preferably somewhat greater than the depths of their respective recesses, so that the flocked material extends slightly beyond the inner surfaces of the plates to contact the playing cards. Various types of flocked material may be used so long as their surfaces produce sufficient static friction to securely hold the playing cards in place, but display a dynamic friction low enough to enable easy insertion and removal of the cards. Examples of suitable materials are felt and Rubbermaid Contact Brand Cushion-All Flocked Covering Material. The latter is a stick-on material which is provided with a removable paper backing and is approximately 0.022 inch (0.559 mm) thick after the backing has been removed.

The plates come into near or actual contact with each other at the bottoms of their respective recesses. The lower end of recess 8 is extended in depth to form a lip 18 which abuts against plate 6 at the lower end of recess 10 to provide a stop for slot 12 along an arcuate path. Viewed another way, stop 18 coincides with the upper end of base 2. The bottom of the base is squared off, allowing the card holder to be stood up vertically during play, and includes a central curvature that makes the device easier to hold by hand. The base also includes a pair of legs 20 which extend out from one side to form a stand for supporting the card holder in a generally upright position. The legs are spaced widely apart so that the card holder can be hand-held without interference from the legs. The undersides of legs 20 extend up from horizontal by an angle of approximately 25°, thus permitting the card holder to be tilted back at an approximately 25° angle to vertical when in use. This provides better visibility of the cards for a player seated at a normal card table.

Figure 4:
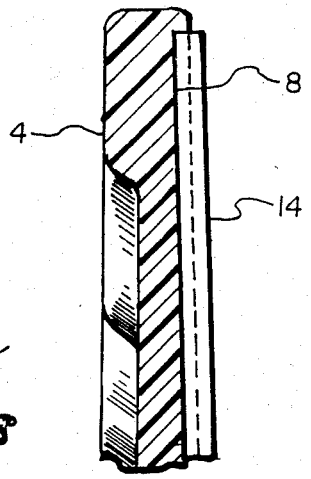
FIG. 4 is an enlarged fragmentary sectional view showing a layer of flocked material for contacting the playing cards recessed in the holder.

An enlarged view of the upper portion of plate 4 is shown in FIG. 4. It can be seen that the recess 8 begins slightly below the top of the plate, and with a depth of about 0.017 inch is shallower than the thickness of flocked material 14. The recess is deep enough to prevent the flocked material from extending out from the plate so far as to interfere with the insertion of cards into the holder, but is shallow enough to ensure that the playing cards make a good surface contact with the flocked material.

The playing card holder described thus far is preferably manufactured in two molded sections, each section including a respective one of the plates and a portion of the base. Various arrangements may be used to hold the sections securely together at the base. For example, the holder can be made from plastics such as polypropylene and polyethylene with snaps provided along the lower portion of one section and mated with sockets in the other section. Alternatively, the holder could be formed from certain types of plastics such as polystyrene which can be chemically or ultrasonically bonded together.

It is desirable that some means be provided to give extra assurance that a player's cards cannot be casually observed by other players. To this end the lateral extremities of the card holder have been curved inwardly toward the player so that the cards will be similarly curved, thus placing their faces at a greater angle to the other players. However, simply curving the card holder has been found to interfere with the ease with which cards may be inserted and removed from the holder if the spacing of the gap between the plates is such as to still securely hold the cards in place. To this end a unique design has been developed which accomplishes the desired extra degree of visual security, and yet permits cards to be inserted and removed with substantially no more difficult than with a perfectly flat holder.

For purposes of description, it will be convenient to reference the card holder to a three-dimensional space which is oriented according to x, y and z axes, as indicated in FIG. 1. The base of the card holder, which essentially extends along a diameter of the semicircular plates, is defined as lying generally in the x-direction, with the semicircular arcuate portions of the plates generally disposed in the x,y plane and generally symmetrical about a y-direction centerline 21. It will be noted that centerline 21 coincides with cut line 2—2 for FIG. 2.

The lateral portions of the plates which are remote from centerline 21 are curved along a generally arcuate locus in the z-direction about an axis 22 which lies generally in the y-direction, thus increasing the visual security of cards placed in the holder. While details of the z-axis curvature are described herein only with respect to the right hand side of the card holder, a symmetrical curvature should be provided for the left hand side of the holder. The z-axis curvature preferably extends generally along an arc B in the approximate range of 25°–50°, and preferably in the range of about 35°–40°. It occupies approximately 15%–30% and preferably about 20%–25% of the length of the holder's base diameter on either side of the centerline.

While the holder described thus far is an improvement over the prior art and provides additional visual security, in use the playing cards are generally inserted and removed from the holder somewhat less easily than if the plates were flat. It has been discovered that the addition of a further z-axis curvature along a different axis for only a portion of the lateral plate sections will preserve the added degree of security, and yet render the manipulation of cards within the holder virtually as convenient as with a flat holder. This additional curvature involves the upper portions of the remote plate sections, which are further curved in the z-direction about an axis 23 that lies generally in the x-y plane at a substantial angle to both the x and y axes. The additional curvature preferably extends generally along an arc C in the approximate range of 20°–45°, and preferably in the range of about 30°–35°. The bottom limit of the approximate bottom limit of the additional curvature is indicated by dashed line 24 in FIG. 1. Projecting the limits of the additional curvature down to the base of the holder, it preferably extends for approximately 10%–25%, and preferably about 15%–20% of the length of the base on either side of the centerline, and is spaced somewhat inwardly from the lateral end of the holder. The axis of curvature 23 for this additional z-direction curvature preferably lies in the x-y plane within the approximate range of 4°–8° to the x-axis.

Referring now to FIG. 5, the inner face of section 6 is shown; the inner face of section 4 is substantially identical. The upper outer periphery 22 of the section, the upper edge 24 of the recess which holds the flocked material and the stop 18 which forms the lower edge of the recess all describe mutually concentric arcs. This results in a protrusion of all the cards in the holder a substantially uniform distance above the holder.

A relatively small number of cards 26 are illustrated as being secured by the holder in FIG. 6. Since the opposed pieces of flocked material are slightly separated at their lower end, the cards bottom out against stop 18. It is a distinct advantage of the invention that it will accommodate a considerably larger number of cards and still hold them with a uniform protrusion above the holder. This is important for games in which the players must be able to hold numerous cards, such as contract bridge, crazy eights and old maid. FIG. 7 illustrates how the holder accommodates a relatively large number of cards 28. Since the thickness of the cards taken together is greater than the spacing between the opposed sections at bottom stop 18, the cards are inserted only partially into the slot. Due to the taper of the slot, the cards can be inserted to a depth above stop 18 at which they are securely held in place, and still extend above the holder by approximately equal amounts.

In operation, the playing card holder is set upright and cards are inserted into the slot 12 between the two plates. It has been found that, with the combination of tapered plates and the flocked inner surface material, either one or a number of overlapping cards will be securely held in place, and yet can be easily removed. It is a distinct advantage of this construction that, when one card is removed, adjacent cards tend to stay in place and are not pulled out along with the moving card. The holder also allows cards to be pulled out, reinserted and rearranged continually without disrupting the other cards or substantially disturbing the uniform card height above the holder, while all the time securing the cards from observation by other players.

Another advantage that was not originally anticipated is that the combination of the curvature applied to the plates, together with the felt or similar linings produces an enhanced holding action on cards that are placed towards the sides of the holder rather than near the top. Cards positioned near the holder extremities might ordinarily be expected to slip somewhat laterally, but the present holder has been found to securely capture such cards in place and yet still permit easy insertion and removal.

Numerous modifications and alternate embodiments of the invention will occur to those skilled in the art. Also, while the invention has been described in terms of a playing card holder, it is equally capable of holding slips of paper, note cards and the like. Accordingly, it is intended that the invention be limited only in terms of the following claims.

I claim:

1. A holder for playing cards, comprising:

first and second plates formed in a three-dimensional space oriented according to x, y and z axes, the plates being defined by respective base portions generally in the x-direction and by upper card contacting portions, both portions being generally disposed in the x,y plane and generally symmetrical about a centerline in the y-direction, said plates being joined together at their base portions and disposed relative to each other with mutually opposed surfaces diverging from each other away from the area of joinder to form a card-receiving slot therebetween for releasably securing playing cards, said slot having an angular divergence which is substantially constant throughout the slot in the approximate range of 1°–8°, the plate sections remote from the centerline and on either side thereof being generally arcuately curved in the z-direction about an axis which lies generally in the y-direction, thereby increasing the visual security of cards placed in the holder, the width of the card receiving slot being small enough to releasably secure playing cards placed in the slot by the opposed lateral pressures of the plates adjacent the cards with no substantial plate movement, and means for supporting the card holder in a generally upright position.

2. The playing card holder of claim 1, wherein the plate sections remote from the centerline are curved generally in the z-direction along an arc in the approximate range of 25°–50°.

3. The playing card holder of claim 2, wherein the plate sections remote from the centerline are curved generally in the z-direction along an arc in the approximate range of 35°–40°.

4. The playing card holder of claim 2, wherein said curved remote plate sections extend along approximately 15%–30% of the length of the base portion on either side of the centerline.

5. A playing card holder comprising:

first and second plates formed in a three-dimensional space oriented according to x, y and z axes, the plates being defined by respective base portions generally in the x-direction and by upper card contacting portions, both portions being generally disposed in the x,y plane and generally symmetrical about a centerline in the y-direction, said plates being joined together at their base portions and disposed relative to each other with mutually opposed surfaces diverging from each other away from the area of joinder to form a card-receiving slot therebetween for releasably securing playing cards, the plate sections remote from the centerline and on either side thereof being curved in the z-direction, thereby increasing the visual security of cards placed in the holder, the upper portions of the plate remote from the centerline being further generally arcuately curved in the z-direction about an axis which lies generally in the x-y plane at substantial angles to both the x and y axes, and means for supporting the card holder in a generally upright position.

6. The playing card holder of claim 5, wherein the additional curvature of the upper portions of the plate sections extends generally along an arc in the approximate range of 20°–45°.

7. The playing card holder of claim 6, wherein the additional curvature of the upper portions of the plate sections extends generally along an arc in the approximate range of 30°–35°.

8. The playing card holder of claim 6, wherein said additional z-direction curvatures extend along approximately 10%–25% of the length of the base diameter portion on either side of the centerline, and are spaced inwardly from the lateral ends of the holder.

9. The playing card holder of claim 5, wherein the axis of curvature for the additional z-direction curvatures lies at an angle within the approximate range of 4°–8° to the x-axis.

10. The playing card holder of claim 1, wherein the opposed surfaces of said plates mutually diverge away from each other with an angular divergence in the approximate range of 3°–5°.

11. The playing card holder of claim 1, wherein the opposed surfaces of said plates are each substantially coated with respective layers of a flocked material.

12. The playing card holder of claim 11, the opposed surfaces of said plates including recesses of lesser depths than the thicknesses of said layers of flocked material, the flocked material being disposed in said recesses.

13. The playing card holder of claim 11, further comprising a generally arcuate stop for the bottom of said slot which is formed along a generally arcuate path generally concentric with the arcuate periphery of the holder, the slot being wide enough at the stop to receive a playing card.

14. The playing card holder of claim 1, said means for supporting the card holder in a generally upright position comprising a plurality of spaced foot members extending outwardly from the bottom of one of said plates for supporting the card holder in a generally upright position at a substantially non-zero angle to vertical.

15. The playing card holder of claim 14, said means for supporting the card holder in a generally upright position further comprising at least a portion of the bottom of the holder being substantially squared to enable the holder to be stood up substantially vertically on its base portion.

16. The playing card holder of claim 1, wherein the central plate sections between the curved sections are substantially flat.

* * * * *